United States Patent [19]

Pond, Sr. et al.

[11] 4,326,579

[45] Apr. 27, 1982

[54] METHOD OF FORMING A FILAMENT THROUGH MELT EXTRACTION

[75] Inventors: Robert B. Pond, Sr., Westminster; John M. Winter, Jr., New Windsor, both of Md.

[73] Assignee: National-Standard Company, Niles, Mich.

[21] Appl. No.: 114,398

[22] Filed: Jan. 23, 1980

[51] Int. Cl.[3] ..... B22D 11/06

[52] U.S. Cl. ..... 164/461; 164/463; 164/423

[58] Field of Search ..... 164/86–88, 164/423, 427–429, 133, 437, 94–96; 264/8, 176 F

[56] References Cited

U.S. PATENT DOCUMENTS

| | | | |
|---|---|---|---|
| Re. 16,856 | 1/1928 | Gelstharp | 164/428 |
| 905,758 | 12/1908 | Strange et al. | 164/87 |
| 2,128,941 | 9/1938 | Hudson | 164/428 |
| 2,770,022 | 11/1956 | Brennan | 164/77 |
| 2,782,473 | 2/1957 | Brennan | 164/82 |
| 2,790,216 | 4/1957 | Hunter | 164/88 |
| 2,912,321 | 11/1959 | Brennan | 164/87 X |
| 2,956,320 | 10/1960 | Pulsifer | 164/87 |
| 3,430,683 | 3/1969 | Hood, Jr. | 164/428 |
| 3,522,836 | 8/1970 | King | 164/87 |
| 3,757,847 | 9/1973 | Sofinsky et al. | 164/277 |
| 3,812,901 | 5/1974 | Stewart et al. | 164/87 |
| 3,838,185 | 9/1974 | Maringer et al. | 264/8 |
| 3,856,074 | 12/1974 | Kavesh | 164/87 |
| 3,861,450 | 1/1975 | Mobley et al. | 164/87 X |
| 3,863,700 | 2/1975 | Bedell et al. | 164/87 |
| 3,896,203 | 7/1975 | Maringer et al. | 164/87 X |
| 3,904,344 | 9/1975 | Maringer et al. | 164/87 X |
| 3,964,963 | 6/1976 | Anderson | 164/87 X |

FOREIGN PATENT DOCUMENTS

| | | | |
|---|---|---|---|
| 24320 | of 1909 | United Kingdom . | |
| 20518 | of 1910 | United Kingdom . | |
| 15548 | of 1913 | United Kingdom . | |
| 128580 | 4/1960 | U.S.S.R. | 164/86 |

*Primary Examiner*—Robert D. Baldwin
*Assistant Examiner*—K. Y. Lin
*Attorney, Agent, or Firm*—Bacon & Thomas

[57] ABSTRACT

A method of forming filaments, particularly continuous strips, sheets or the like, by rotating a chill wheel against a meniscus of molten material formed about the periphery of an elongate orifice through which the molten material is fed under uniform fluid pressure along the longitudinal axis of the orifice. Filaments of different widths, thicknesses and composite structures are extracted by utilizing single or plural chill wheels in conjunction with plural orifices.

19 Claims, 8 Drawing Figures

METHOD OF FORMING A FILAMENT THROUGH MELT EXTRACTION

BACKGROUND OF THE INVENTION

1. Field of the Invention

The present invention generally relates to the field of melt extraction wherein solidifying filaments are extracted from a source of molten material by means of a rotating heat-extracting member, such as a chill wheel or disk. More particularly, the invention involves melt extraction wherein the molten material is fed to the chill wheel through an orifice or nozzle.

2. Description of the Prior Art

The basic technique of extracting continuous or discontinuous filaments of controlled length from a source of molten material by contacting the latter with a rotating heat-extracting member is well documented in the prior art. This procedure involves utilizing a chill wheel or disk having a peripheral surface which, when rotated against the surface of the molten material, immediately solidifies and removes a filamentary product of the material on the peripheral surface, with the product being thereafter spontaneously released by the rotating member.

It is known to extract filaments by rotating chill wheels or disks directly against the surface of an open bath of molten material, such as molten metal. This is known as the open bath technique of melt extraction and is inherently difficult to control for several reasons. First, the rotating action of the chill wheel causes a pumping action within the molten bath which in turn causes fluid turbulence which, if large enough, causes premature termination of the extraction process. This turbulence increases with the rotational velocity of the wheel and also causes nonuniform product configuration and structure. Another problem attendant the open bath technique involves the wide exposure of the molten metal to any atmosphere which causes oxidation products to accumulate around the critical extraction area, thereby causing the incorporation of oxide impurities into the solidified product. Examples of the open bath technique for melt extraction and proposals for overcoming the problems associated therewith are disclosed by the Mobley U.S. Pat. No. 3,861,450; Bedell et al. U.S. Pat. No. 3,863,700 and Maringer et al. U.S. Pat. No. 3,094,344.

Another fundamental technique utilized in the practice of melt extraction involves the feeding of the molten material through an orifice or nozzle so that the problems inherent with the open bath technique can be minimized and the size and shape of the filamentary product can be better controlled. This is known as the orifice technique and utilizes a rotating chill wheel which pulls the molten material directly from the orifice or mouth of the nozzle, thereby minimizing fluid turbulence and the exposed surface area of the melt. The rate of production of a filament by the orifice technique is dependent not only upon the rotational velocity of the chill wheel, but also on the rate at which the molten material is fed through the orifice. The basic orifice technique is well exemplified in early disclosures, particularly Strange et al. U.S. Pat. No. 905,758; Strange et al. British Pat. No. 155,548 (1913); and Strange British Pat. No. 24,320 (1909).

While the orifice technique does provide fundamental advantages over the open bath technique of melt extraction, the former technique nevertheless is also confronted with potential problems and considerations that may hinder continuous melt extraction and precise product control. Correlating the rotational velocity of the chill wheel with the molten material feed rate from the orifice is critical in assuring a product of uniform configuration and thickness. The orifice itself must be defined by an aperture formed by a solid material that has sufficient resistance to degradation under high heat conditions, particularly those required for extracting high melting point metals. Control of product quality is also dependent upon the actual shape or configuration of the orifice and its disposition with respect to the rotating chill wheel. Despite the small exposed surface area afforded by the orifice technique, the undesirable formation of oxides is still possible when molten metals are being extracted.

Prior art efforts to overcome some of the problems confronting the orifice technique of melt extraction have included the Maringer et al U.S. Pat. No. 3,896,203 which, in one embodiment of the invention disclosed thereby, utilizes an inverted container having a small orifice at its lowermost end to provide a controlled gravity feed of molten metal through the maintenance of a stable pendant drop of the metal at the orifice for contact by the outer circumferential edge of a rotating disk-like heat extracting member. The Strange British Pat. No. 20,518 (1910) and King U.S. Pat. No. 3,522,836 both propose the broad concept of extracting molten metal from a meniscus formed at the exit orifice of a feed nozzle.

The heretofore prior art efforts at melt extraction through the orifice technique have not generally resulted in consistent product quality. This is particularly evident when strips or ribbons of metal are being extracted. Because of the obvious economical advantages derived from making metal products, such as containers, from metal strip stock requiring a minimum of mechanical treatment, it is extremely desirable that high quality metal strips be produced through melt extraction. Moreover, there also exists a great need for both efficient and economical production of metal strips having almost any desired thickness or composite structure through melt extraction according to the orifice technique.

SUMMARY OF THE INVENTION

It is an object of the invention to provide a simple and economical method for producing solidified strips of material from a molten bath thereof.

It is another object of the invention to provide an extremely efficient method for producing filamentary products, particularly metal strips, ribbons, sheets and the like, through the practice of melt extraction.

It is yet another object of the invention to provide a method of making metal strips, ribbons and the like of consistent quality and having any desired width and thickness.

It is still yet another object of this invention to provide a method of melt extraction wherein the orifice technique is utilized to rapidly produce continuous filamentary products defined by homogeneous or composite structures.

The foregoing and other objects are achieved by providing an improved method of melt extracting filamentary products directly from a source of molten material by feeding the molten material through an orifice having a specific configuration for maintaining a stable meniscus of the molten material about the periphery of the orifice for rapid removal by a rotating chill wheel. The orifice is defined by an elongate opening formed in a flat member wherein the ratio of the width to height of the orifice is less than or equal to approximately 1 to provide uniform feed pressure along the length of the orifice. The molten material is fed substantially upwardly through the orifice for removal by the chill wheel disposed thereabove. By utilizing plural molten material sources and orifices, solidified filamentary products having a strip-like configuration can be produced with one or more chill wheels, with such strips possessing any desired width and thickness of homogeneous or composite structure.

DETAILED DESCRIPTION OF THE INVENTION

Figure 1:
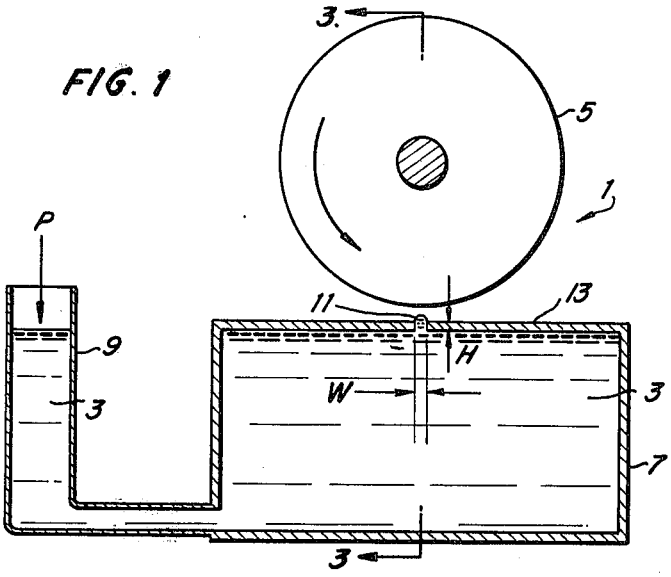
FIG. 1 is a side view of a system for practicing a first embodiment of the invention wherein a rotating chill wheel is disposed just above a meniscus of molten material maintained about the periphery of a feed orifice.

A first embodiment of the invention is shown in FIG. 1 wherein a system 1 is provided for melt extracting a source of molten material 3 by means of a rotating chill wheel 5 having a cylindrical shape. Material 3 may comprise molten metal or other material capable of being melt extracted and is shown within a container 7 made from refractory or other heat resistant composition. A fill tube 9 preferably serves the dual function of replenishing material 3 removed by wheel 5 and imposing a feed pressure P on the surface of material 3 in tube 9 for the purpose of feeding melt 3 substantially upwardly through an orifice 11 disposed at the upper portion of container 7.

Orifice 11 is of an elongate configuration and may be substantially rectangular or slot-shaped in appearance. It is preferred that orifice 11 be formed within a flat plate member 13, with the ratio of the width W to height H of the orifice being less than or equal to approximately 1. By virtue of the elongate configuration of orifice 11 and the indicated width to height ratio, a uniformity of upward fluid flow pressure across the entire longitudinal axis of orifice 11 is made possible. This uniform pressure condition exists notwithstanding the degree of feed pressure P imposed upon the surface of melt 3 contained within tube 9. The application of feed pressure P may be achieved by utilizing compressed fluids, mechanical pistons or similar devices, or any other pressurization appliance (not shown) well known in the art for this purpose. Pressure indication means (not shown) is also desirable for regulating the amount of pressure applied within tube 9 so that the rate of feed of melt 3 through orifice 11 may be correlated with the extraction rate determined by the rotational velocity of wheel 5.

As seen in FIG. 1, by applying feed pressure P within tube 9, melt 3 is caused to be fed substantially upwardly through orifice 11 so that a convex-shaped meniscus 15 is formed about the external periphery of orifice 11, with meniscus 15 assuming an elongate configuration corresponding to that of orifice 11. By maintaining a sufficient degree of pressure P in tube 9, meniscus 15 will remain extremely stable by virtue of its substantially vertical orientation and the anchoring effect imposed by the external periphery of orifice 11.

Figure 2:
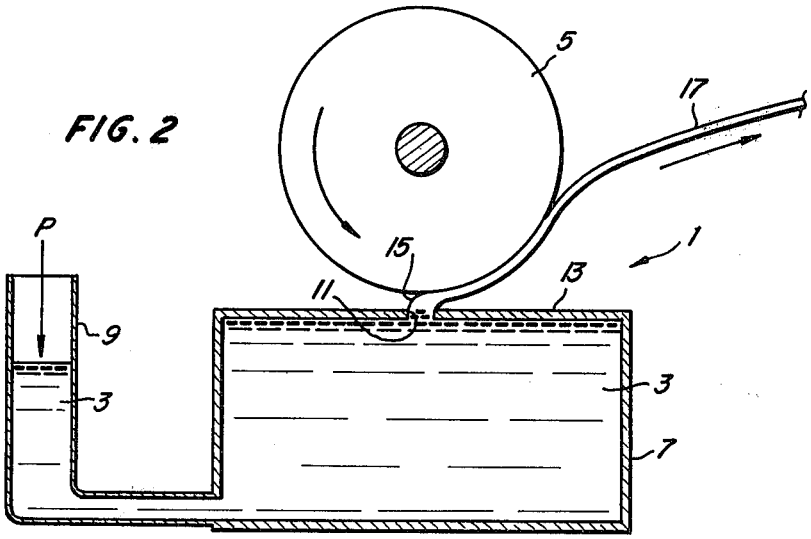
FIG. 2 is the same embodiment as shown in FIG. 1 wherein the rotating chill wheel is in contact with the meniscus of molten material for solidifying and removing a filament thereof.

The actual extraction of melt 3 is depicted in FIG. 2 wherein wheel 5 has been lowered so that its rotating circumferential surface just barely "kisses" or touches the uppermost portion of meniscus 15. At this moment, melt 3 is continuously removed from meniscus 15 to form a solidified filamentary product 17 having the general configuration of a flat strip or ribbon by virtue of the cylindrical shape of wheel 5. During the extraction process, the thickness of filament 17 can be controlled by varying the rotational velocity of wheel 5, with thickness decreasing in proportion to increasing rotational velocity. To accommodate the rate of melt extraction by varying the rotational velocity of wheel 5, the amount of feed pressure P must be increased or decreased in accordance therewith so that a stable meniscus 15 will always be maintained at orifice 11.

Figure 3:
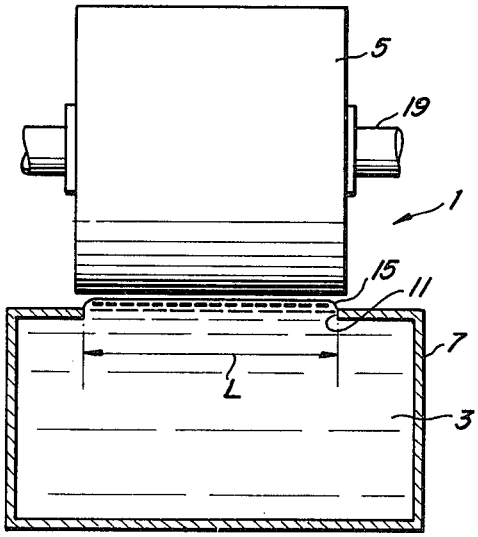
FIG. 3 is a partial cross-sectional view taken along the line 3—3 of FIG. 1.

The elongate configuration of slot 11 is shown in FIG. 3 as defined by length L which is substantially longer than its width W. The length of meniscus 15 corresponds approximately to that of length L and is preferably of the same length as wheel 5. The ultimate width of filament 17 is generally determined by the width of wheel 5, though it is of course possible to extract a filament from a meniscus having a shorter length than that of wheel 5. Moreover, it is also possible to extract a filament by means of a chill wheel having a length that is shorter than that of the meniscus.

Chill wheel 5 is preferably constructed of solid heat conducting metal, such as copper, or may be in the form of a hollow drum that is internally cooled by means of a suitable fluid coolant, such as air or water. As shown in FIG. 3, wheel 5 is supported for rotation about its longitudinal axis by means of a drive shaft 19 connected to a suitable pulley drive and motor system (not shown). Wheel 5 is also preferably supported for vertical movement with respect to meniscus 15 so that its depth of contact therewith can be correlated with the rotational velocity of wheel 5 and amount of feed pressure P imposed within tube 9.

Figure 4:
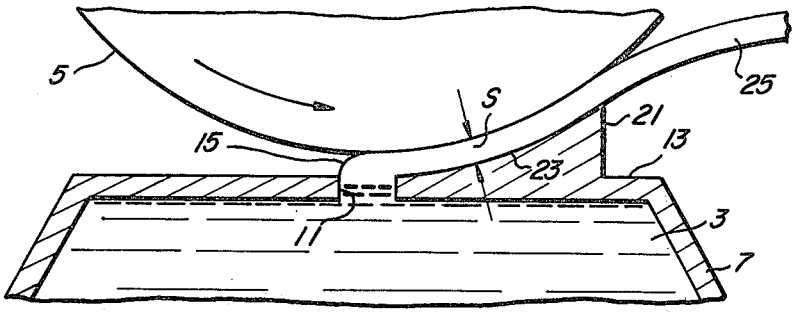
FIG. 4 is a partial side view depicting a system for practicing a second embodiment of the invention.

A second embodiment of the invention is shown in FIG. 4 wherein the forward portion of plate 13 within which orifice 11 is formed includes a projection 21 which is of the same length as orifice 11 and includes an arcuate-shaped upper surface 23 having a radius of curvature corresponding to that of the peripheral surface of wheel 5. The spacing S defined between wheel 5 and surface 23 serves essentially as a mold cavity for prolonged contact of melt 3 against wheel 5 to thereby permit a solidification and extraction of a filament 25 having a substantially greater thickness than that of filament 17 in FIG. 2.

Figure 5:
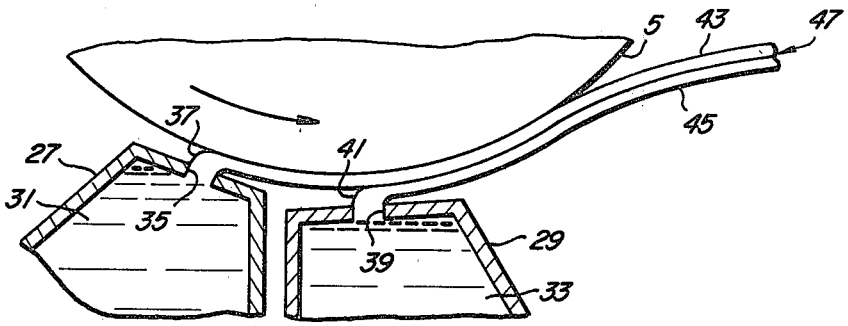
FIG. 5 is a partial side view of a system for practicing a third embodiment of the invention.

A third embodiment of the invention is shown in FIG. 5 wherein there is provided a pair of containers 27 and 29 for containing separate sources of melt 31 and 33, respectively. Container 27 is provided with an elongate orifice 35 for maintaining a meniscus 37 of melt 31 being fed therethrough. Similarly, container 29 is provided with an elongate orifice 39 which maintains a stable meniscus 41 of melt 33 being fed therethrough. Containers 27 and 29 are disposed with the longitudinal axes of orifices 35 and 39 in series about the periphery of chill wheel 5 and parallel to the longitudinal axis thereof. In this manner, when wheel 5 is lowered against the upper portions of meniscuses 37 and 41, it extracts a pair of filaments 43 and 45, respectively, therefrom. Because of the relative close spacing between meniscuses 37 and 41 to each other, filament 43 forms first and essentially serves to extract filament 45 from meniscus 41. Subsequent solidification of filaments 43 and 45 provides a uniform filament 47 having a thickness equal to the combined individual thicknesses of filaments 43 and 45. Melts 31 and 33 may be of the same or different materials to permit the extraction of either homogeneous or composite filaments. When different metal melts are used, bimetallic strips can be extracted by this embodiment of the invention.

As indicated in FIG. 5, melts 31 and 33 are both fed substantially upwardly through respective orifices 35 and 39, with the latter orifice being disposed almost directly below wheel 5 at about a six o'clock position. Orifice 35 is disposed adjacent orifice 39 at substantially a seven o'clock position. Some variation in positioning of the orifices about the periphery of wheel 5 is possible within the practice of this invention so long as a stable meniscus is maintained about the external periphery thereof from melt being fed in a substantially upward direction.

Figure 6:
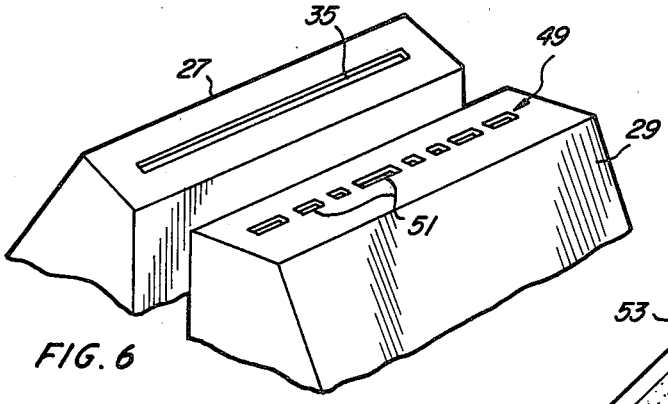
FIG. 6 is a partial perspective view depicting a modified orifice system for practicing the third embodiment of the invention as shown in FIG. 5.
Figure 7:
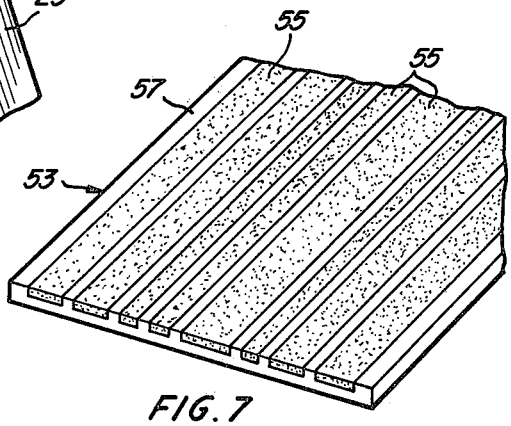
FIG. 7 is a partial perspective view of a composite strip produced by the orifice system shown in FIG. 6.

A modification of the orifice assembly used to practice the third embodiment of FIG. 5 is shown in FIG. 6. In this modification, elongate orifice 35 is continuous and utilized in conjunction with a discontinuous elongate orifice indicated at 49. Orifice 49 is defined by a plurality of smaller separate apertures 51 disposed in linear array, with each aperture 51 having a substantially rectangular shape and a width to height ratio of less than or equal to approximately 1. Apertures 51 are of the same width and may all be of the same length or, if desired, of different lengths. The collective configuration of apertures 51 define the overall elongate configuration of orifice 49. This orifice assembly modification is particularly useful in producing an inlaid composite strip 53 as shown in FIG. 7. Strip 53 may be extracted from two different molten metal melts, such as steel and copper, to form a bimetallic composite defined by copper inlays 55 of equal or random width within a steel matrix 57.

Figure 8:
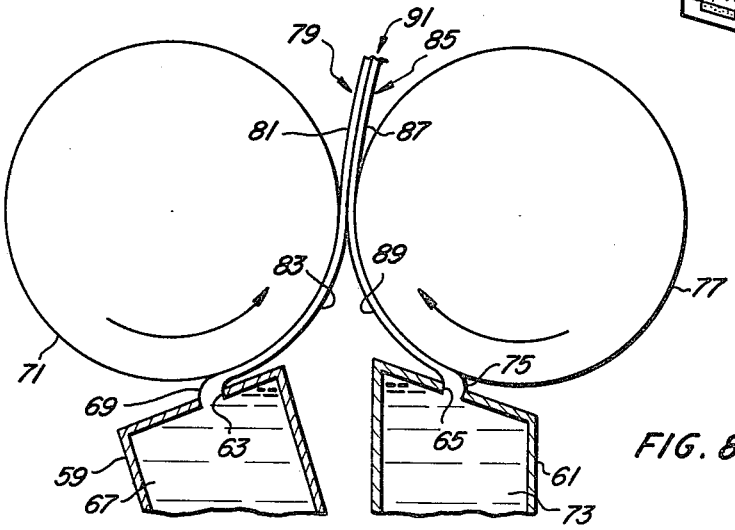
FIG. 8 is a side view depicting a system for practicing a fourth embodiment of the invention.

A fourth embodiment of the invention is depicted in FIG. 8 wherein a pair of containers 59 and 61 are provided with a pair of corresponding elongate orifices 63 and 65, respectively. A melt 67 is fed through orifice 63 to form a stable meniscus 69 which is removed by a chill wheel 71 rotating in a counterclockwise direction. Similarly, a melt 73 is fed through orifice 65 to form a stable meniscus 75 that is in turn removed by a second chill wheel 77 rotating in a clockwise direction.

Wheel 71 extracts a filament 79 that is defined by a mold surface 81 and a free surface 83. Likewise, a filament 85 extracted by wheel 7 also includes a mold surface 87 and a free surface 89. As is apparent, mold surfaces 81 and 87, being in direct contact with the surfaces of their respective wheels 71 and 77, are solidified into surfaces of smooth and uniform quality. By contrast, free surfaces 83 and 89, being exposed to the ambient atmosphere, almost inevitably solidify into surfaces that are variegated and nonuniform, often characterized by pitting and hollow sections. However, through this embodiment of the invention, free surfaces 83 and 89 are caused to come together substantially immediately after extraction so that they are bonded through solidification of the melts. In this way, a single filament, indicated generally at 91, is produced with uniform and smooth exterior mold surfaces 81 and 87. This embodiment is also useful in the production of composite filaments from two different melt sources, such as bimetallic strips from molten metal melts of steel and copper.

Though the present invention may be practiced with any known material which in its molten form is capable of being melt extracted into filamentary form, it has its greatest advantage in the production of metallic filaments in the form of strips, ribbons, sheets and the like. Some metals capable of being used in the practice of the invention include steel and ferrous alloys, copper, aluminum, zinc, tin, lead, bismuth, silicon, and alloys thereof. In manufacturing technology, to make articles from metallic sheet, the metal feed stock must necessarily undergo time consuming and expensive rolling or mechanical working to achieve an appropriate thickness. Through this invention, metal feed stock of almost any desired width and appropriate thickness can be quickly produced and utilized almost immediately for mechanical shaping into the desired article of manufacture and with only a minimum of additional mechanical working. This is made possible through the use of the above described elongate orifice in the form of a very narrow slot which eliminates fluid waves and turbulence and permits the anchoring thereon of a stable meniscus from which a solidified filament may be extracted at extremely high production rates. By maintaining the slot configuration with a width to height ratio of less than or equal to approximately 1, melt feed pressure is uniformly distributed across the entire length of the orifice, thereby providing equal feed volume across the chill wheel.

Through the practice of the invention, it has been found that aluminum can be extracted at a rate of 20 feet per second into a strip 6 inches wide and having a thickness of 13–15 mils. Similarly, stainless steel strips of 2 inch width and 24 mils thickness have also been extracted at a rate of 4 feet per second. Moreover, the invention has also successfully extracted amorphous alloy (iron-boron) of ½ inch width and 0.2 mil thickness at an extremely rapid production rate of 160–190 feet per second.

It is to be understood that the embodiments of the invention herein shown and described are to be taken as preferred examples of the same, and that various changes in shape, size, arrangement of parts, compositions and method of practice may be resorted to without departing from the spirit of the invention or the scope of the subjoined claims.

We claim:

1. A method of forming a filament through melt extraction comprising:

(a) providing at least one source of molten material;

(b) feeding the molten material substantially upwardly through at least one orifice having an elongate configuration, wherein the orifice is defined by a slot formed in a plate, with the slot having a width to height ratio of less than or equal to approximately 1 for providing a uniform distribution of fluid feed pressure across the entire length of the slot;

(c) maintaining a stable meniscus of the molten material about the periphery of the orifice; and (d) rotating a chill wheel against the meniscus of molten material to extract a solidifying filament of the material therefrom.

2. The method of claim 1 wherein the plate includes an arcuate portion spaced from the chill wheel to define a mold cavity therebetween for prolonging contact of the solidifying filament with the chill wheel.

3. The method of claim 2 wherein the radii of curvature of the chill wheel and arcuate portion are substantially equal and disposed in parallel relationship.

4. The method of claim 1 wherein the chill wheel is of cylindrical-shape and has a length substantially equal to that of the meniscus.

5. The method of claim 1 further including the step of controlling the thickness of the solidifying element by varying the rotational speed of the chill wheel.

6. The method of claim 1 wherein the molten material is molten metal.

7. The method of claim 6 wherein the metal is a member selected from the group consisting of steel, iron, ferrous alloys, copper, aluminum, zinc, tin, lead, bismuth, silicon, and alloys thereof.

8. The method of claim 1 wherein the feeding of the molten material is achieved by pressurizing same.

9. The method of claim 8 wherein the pressurizing is effected by applying fluid pressure to the molten material.

10. The method of claim 8 wherein the pressurizing is effected by applying mechanical pressure to the molten material.

11. The method of claim 1 further including:

(a) feeding the molten material through a plurality of separate orifices;

(b) maintaining a stable meniscus of the molten material about the periphery of each orifice;

(c) rotating a chill wheel against at least one of the meniscuses to extract a plurality of separate solidifying filaments from the meniscuses; and (d) combining the separate solidifying filaments together substantially immediately after their extraction to form a single solidified filament.

12. The method of claim 11 wherein the chill wheel is of cylindrical shape and the meniscuses are disposed with their longitudinal axes in series around and substantially parallel to the longitudinal axis of the chill wheel.

13. The method of claim 11 further including feeding plural sources of different kinds of molten material through the orifices for extracting a composite solidified filament.

14. The method of claim 11 further including feeding the molten material through a pair of orifices, with one orifice being defined by a continuous slot and the other orifice being defined by a discontinuous slot.

15. The method of claim 14 wherein the discontinuous slot includes a plurality of separate apertures disposed in a linear array.

16. The method of claim 1 further including:

(a) feeding the molten material through a plurality of separate orifices;

(b) maintaining a stable meniscus of the molten material about the periphery of each orifice;

(c) rotating a separate chill wheel against each meniscus to extract a solidifying filament therefrom; and (d) combining the separate solidifying filaments together substantially immediately after their extraction to form a single solidified filament.

17. The method of claim 16 wherein the molten material includes molten metal.

18. The method of claim 16 wherein:

(a) the molten material is fed through a pair of separate orifices;

(b) each filament includes both a mold surface in contact with its corresponding chill wheel and a free surface; and (c) the separate solidifying filaments are combined by bonding the free surfaces thereof together through solidification.

19. The method of claim 18 further including feeding a different kind of molten material from a separate source through each orifice to form a single composite solidified filament.

* * * * *